US006908401B2

(12) United States Patent
Cheng

(10) Patent No.: US 6,908,401 B2
(45) Date of Patent: Jun. 21, 2005

(54) SHAFT FOR USE IN GOLF CLUBS AND OTHER SHAFT-BASED INSTRUMENTS AND METHOD OF MAKING THE SAME

(76) Inventor: Michael H. L. Cheng, 3141 Geronimo, Simi Valley, CA (US) 93063

( * ) Notice: Subject to any disclaimer, the term of this patent is extended or adjusted under 35 U.S.C. 154(b) by 0 days.

(21) Appl. No.: 09/794,657

(22) Filed: Feb. 28, 2001

(65) Prior Publication Data

US 2002/0119829 A1 Aug. 29, 2002

(51) Int. Cl.[7] ..... A63B 53/10; A63B 53/12

(52) U.S. Cl. ..... 473/320

(58) Field of Search ..... 473/316–323, 473/309; 428/36.3, 36.9; 264/635; 156/187, 188

(56) References Cited

U.S. PATENT DOCUMENTS

| | | | | | |
|---|---|---|---|---|---|
| 556,819 | A | * | 3/1896 | Hartman | 138/156 |
| 1,765,709 | A | * | 6/1930 | Withington | 228/150 |
| 1,774,385 | A | * | 8/1930 | Lard | 473/319 |
| 1,942,465 | A | * | 1/1934 | Young | 228/150 |
| 2,177,970 | A | * | 10/1939 | Wettlaufer | 473/316 |
| 3,313,541 | A | | 4/1967 | Benkoczy | |
| 3,646,610 | A | | 2/1972 | Jackson | |
| 3,653,882 | A | | 4/1972 | Petrasek | |
| 3,998,458 | A | | 12/1976 | Inoue | |
| 4,000,896 | A | | 1/1977 | Lauraitis | |
| 4,023,801 | A | | 5/1977 | Van Auken | |
| 4,082,277 | A | | 4/1978 | Van Auken | |
| 4,084,819 | A | | 4/1978 | Van Auken | |
| 4,097,626 | A | | 6/1978 | Tennent | |
| 4,119,748 | A | | 10/1978 | Verbauwhede | |
| 4,135,035 | A | | 1/1979 | Branen | |
| 4,157,181 | A | | 6/1979 | Cecka | |
| 4,319,750 | A | | 3/1982 | Roy | |
| 4,657,795 | A | | 4/1987 | Foret | |
| 4,757,997 | A | | 7/1988 | Roy | |
| 4,834,693 | A | | 5/1989 | Profant | |
| 4,836,545 | A | | 6/1989 | Pompa | |
| 4,889,575 | A | | 12/1989 | Roy | |
| 4,916,029 | A | | 4/1990 | Nagle | |
| 5,028,464 | A | | 7/1991 | Shigetoh | |
| 5,049,422 | A | | 9/1991 | Honma | |
| 5,088,735 | A | | 2/1992 | Shigetoh | |
| 5,093,162 | A | | 3/1992 | Fenton | |
| 5,143,374 | A | | 9/1992 | Shibasaki | |
| 5,156,396 | A | | 10/1992 | Akatsuka | |
| 5,251,896 | A | | 10/1993 | Gerlach | |
| 5,253,867 | A | | 10/1993 | Gafner | |
| 5,265,872 | A | | 11/1993 | Tennent | |
| 5,265,911 | A | | 11/1993 | Goode | |
| 5,279,879 | A | | 1/1994 | Takezawa | |
| 5,294,119 | A | * | 3/1994 | Vincent et al. | 473/318 |
| 5,308,062 | A | * | 5/1994 | Hogan | |
| 5,326,099 | A | | 7/1994 | Yamamoto | |
| 5,385,767 | A | | 1/1995 | Noguchi | |
| 5,437,450 | A | | 8/1995 | Akatsuka | |
| 5,505,492 | A | | 4/1996 | Nelson | |
| 5,545,094 | A | | 8/1996 | Hsu | |
| 5,549,947 | A | | 8/1996 | Quigley | |
| 5,551,691 | A | | 9/1996 | Harada | |
| 5,599,242 | A | | 2/1997 | Solviche | |
| 5,626,529 | A | | 5/1997 | Roy | |

(Continued)

FOREIGN PATENT DOCUMENTS

JP 5-161727 * 6/1993

OTHER PUBLICATIONS

U.S. Appl. No. 09/602,049, filed Jun. 23, 2000, and claims as of Oct. 22, 2003.

*Primary Examiner*—Stephen Blau
(74) *Attorney, Agent, or Firm*—Henricks, Slavin & Holmes LLP

(57) ABSTRACT

A shaft for use in a golf-club or other shaft-based instrument, including a base member and a metal layer, and a method of making the same.

20 Claims, 5 Drawing Sheets

U.S. PATENT DOCUMENTS 5,665,441 A 9/1997 Suzue
5,755,826 A * 5/1998 Beach
5,788,585 A 8/1998 Jackson
5,913,734 A * 6/1999 Tanaka ..... 473/320
5,943,758 A * 8/1999 Haas
5,944,618 A 8/1999 Cheng
5,957,783 A 9/1999 Cheng
6,139,444 A * 10/2000 Renard
6,273,830 B1 8/2001 Takemura

* cited by examiner

SHAFT FOR USE IN GOLF CLUBS AND OTHER SHAFT-BASED INSTRUMENTS AND METHOD OF MAKING THE SAME

BACKGROUND OF THE INVENTIONS

1. Field of the Inventions

The present inventions relate generally to shaft-based instruments and, more particularly, to shafts for use in golf clubs and other shaft-based instruments.

2. Description of the Related Art

Over the years, there have been a variety of attempts to improve shaft-based instruments such as golf clubs, ski poles and hockey sticks. With respect to golf clubs, many substitutes have been introduced for the hard wood shafts originally used in golf club drivers and irons. Early substitute materials included stainless steel and aluminum. More recently, carbon fiber reinforced resin shafts have become popular. Such shafts are typically hollow and consist of a shaft wall formed around a tapered mandrel. The use of fiber reinforced resin has allowed golf club manufacturers to produce shafts having varying degrees of strength, flexibility and torsional stiffness. Carbon fiber reinforced resin shafts have also become popular in other shaft-based instruments. As such, manufacturers are able to produce shafts which suit the needs of a wide variety of applications.

Nevertheless, manufactures of shaft-based instruments are faced with a variety of design issues that have proven difficult to overcome using conventional fiber reinforced resin technologies. One issue associated with shaft design is related to the torsional and longitudinal stiffness of the shafts and, in the golf club shaft context, the attempts of designers to increase torsional stiffness (especially near the club head) in order to improve shot accuracy and increase longitudinal stiffness in order to cope with the ever increasing swing velocities of golfers. Another issue associated with shaft design is the location of the shaft flex point. More specifically, the inability of shaft designers to precisely predict the location of the flex point when designing a shaft without using excessive amounts of composite material, which can lead to weight and thickness issues, can be problematic. Breakage prevention is another important design issue. With respect to golf club shafts, for example, breakage often occurs within the region of the main body section that is adjacent to the club head.

SUMMARY OF THE INVENTIONS

The general object of the present inventions is to provide shafts that eliminate, for practical purposes, the aforementioned problems. In particular, one object of the present inventions is to provide golf club shafts and other shafts that have greater torsional and longitudinal stiffness than conventional fiber reinforced resin shafts. Another object of the present inventions is to provide golf club shafts and other shafts which facilitate precise location of the flex point. Still another object of the present inventions is to provide golf club shafts and other shaft that resist breakage.

In order to accomplish these and other objectives, a shaft in accordance with the present invention includes a plurality of fiber reinforced resin layers and a metal layer. The metal layer may, for example, be formed from a lightweight, high modulus of elasticity and tensile strength material such as titanium. Such a shaft provides a number of advantages over conventional shafts. For example, the metal layer augments the shafts torsional and longitudinal stiffness. Shaft designers can also adjust the location of the flex point by simply adjusting the length of the metal layer. The metal layer will also prevent breakage. In golf club shafts, for example, the metal layer may extend along the tip section from a point within the club head hosel to a point outside the hosel. This arrangement strengthens the area of the tip section adjacent to the club head that is a frequent area of breakage in conventional golf club shafts and also provides torsional rigidity.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the inventions. The scope of the inventions is defined by the appended claims. Additionally, although the present inventions are described herein in the golf club shaft context because the inventions are particularly well suited to golf club shafts, the inventions are not so limited. The inventor herein has determined that present inventions have application in other shaft-based devices such as, for example, ski poles and hockey sticks.

Figure 1:
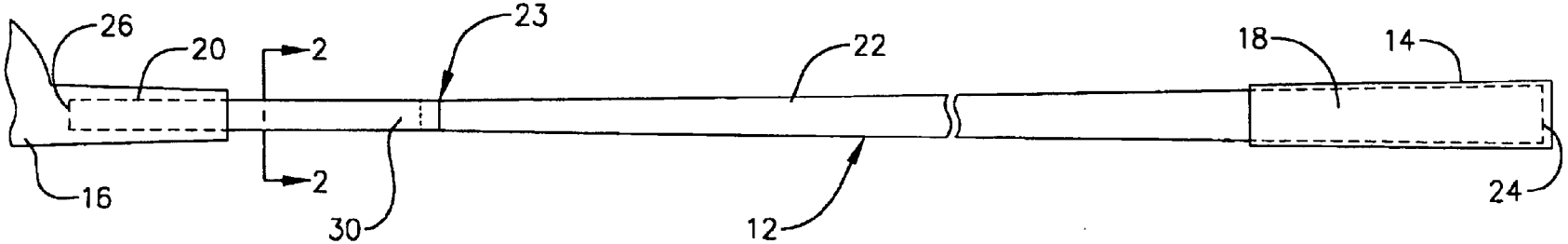
FIG. 1 is a side view of a golf club in accordance with a preferred embodiment of a present invention.

As illustrated for example in FIG. 1, a golf club shaft 10 in accordance with a preferred embodiment of a present invention includes a hollow shaft 12, a grip 14, and a club head 16. The exemplary shaft 12 is divided into three sections—the grip section 18 which is covered by the grip 14, the tip section 20 which supports the club head 16, and the main body section 22 which extends from the distal end of the grip section to the proximal end of the tip section. The tip section/main body section intersection is identified by reference numeral 23. In the illustrated embodiments, the grip section 18 is substantially cylindrical, the tip section 20 is substantially cylindrical, and the main body section 22 has a frusto-conical shape with a substantially constant taper. The exemplary shaft 12 also includes a butt (or "proximal") end 24 and a tip (or "distal") end 26. The present inventions are not, however, limited to such a configuration. Other grip section, tip section and main body section configurations and shapes, such as those disclosed in commonly assigned U.S. Pat. Nos. 5,944,618 and 5,957,783, both of which are incorporated herein by reference, may also be employed.

It should be noted that the dimensions of the shafts illustrated in the drawings are exaggerated and often not to scale. Commercial embodiments of golf club shafts in accordance with the present inventions may range from about 33 inches to about 46 inches in overall length. With respect to the tip section 20, the length may range from about 3 inches to about 8 inches and the outer diameter (OD) may range from about 0.370 inch to about 0.500 inch for irons and from about 0.335 inch to about 0.500 inch for woods. The typical club head hosel, i.e. the portion of the club head that receives the shaft, is about 1 inch. Thus, the tip section 20 will extend proximally beyond the hosel in the manner illustrated in FIGS. 1 and 5*a*. The length of the grip section 18 may range from about 6 inches to about 10 inches. The exemplary grip section may be either substantially cylindrical (as shown) with an OD of about 0.58 inch to about 0.62 inch or tapered from an OD of about 0.81 inch to about 1.0 inch at the butt to an OD of about 0.55 inch to about 0.70 inch at the grip section/main body section intersection. The wall thickness is preferably between about 0.024 inch and about 0.059 inch (between about 0.6 mm and about 1.5 mm).

Figure 3:
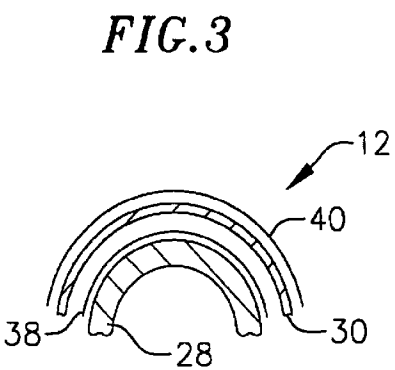
FIG. 3 is a partial, exploded view of the portion of the golf club shaft illustrated in FIG. 2.
Figure 2:
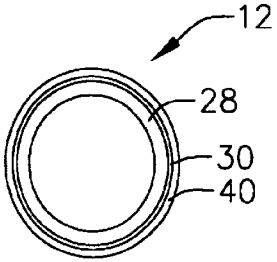
FIG. 2 is a section view taken along line 2—2 in FIG. 1.
Figure 4:
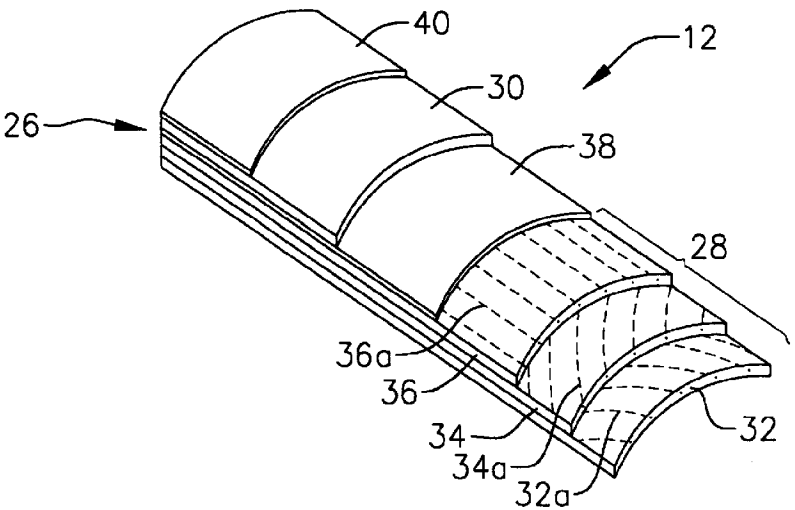
FIG. 4 is a cutaway view of a portion of the golf club shaft illustrated in FIG. 1 with various layers of the shaft cutaway by different amounts to expose the layers.

The exemplary shaft 12 consists of two primary components—a polymer base member 28 and a metal layer 30. Referring to FIGS. 2–4, the exemplary base member 28 is a fiber reinforced resin base member that may be formed in conventional fashion by wrapping multiple layers (typically 10–20 layers total) of a fiber reinforced resin composite over a mandrel until the desired wall thickness is obtained. The layers are preferably arranged in groups that each include a plurality of fiber reinforced resin layers. In the illustrated embodiment, layer groups 32, 34 and 36 are oriented at different angles with respect to the longitudinal axis of the shaft 12. The fibers within the respective layers of each group are parallel to one another. More specifically, the fibers 32*a* and 34*a* in the layers within groups 32 and 34 are angled from 30–90 degrees with respect to the longitudinal axis of the shaft, while the fibers 36*a* in layer group 36 are parallel to the longitudinal axis. Other layer and layer group combinations may also be employed in embodiments of the present invention. For example, layer groups 32 and 34 may be combined (a total of 5–10 layers, for example) and the individual layers arranged such that the fibers in successive layers are oriented at different angles with respect to the longitudinal axis.

The exemplary base member 28 may be manufactured using any of the materials typically used to produce composite resin/fiber golf club shafts. Suitable resins include, for example, thermosetting resins or polymers such as polyesters, epoxies, phenolics, melamines, silicones, polimides, polyurethanes and thermoplastics. Suitable fibers include, for example, carbon-based fibers such as graphite, glass fibers, aramid fibers, and extended chain polyethylene fibers. After the successive layers of fiber reinforced resin are wrapped around the mandrel, the shaft is cured in an oven. Curing times and temperatures depend on the polymer used in the composite and are well known to those of skill in the art.

Figure 5A:
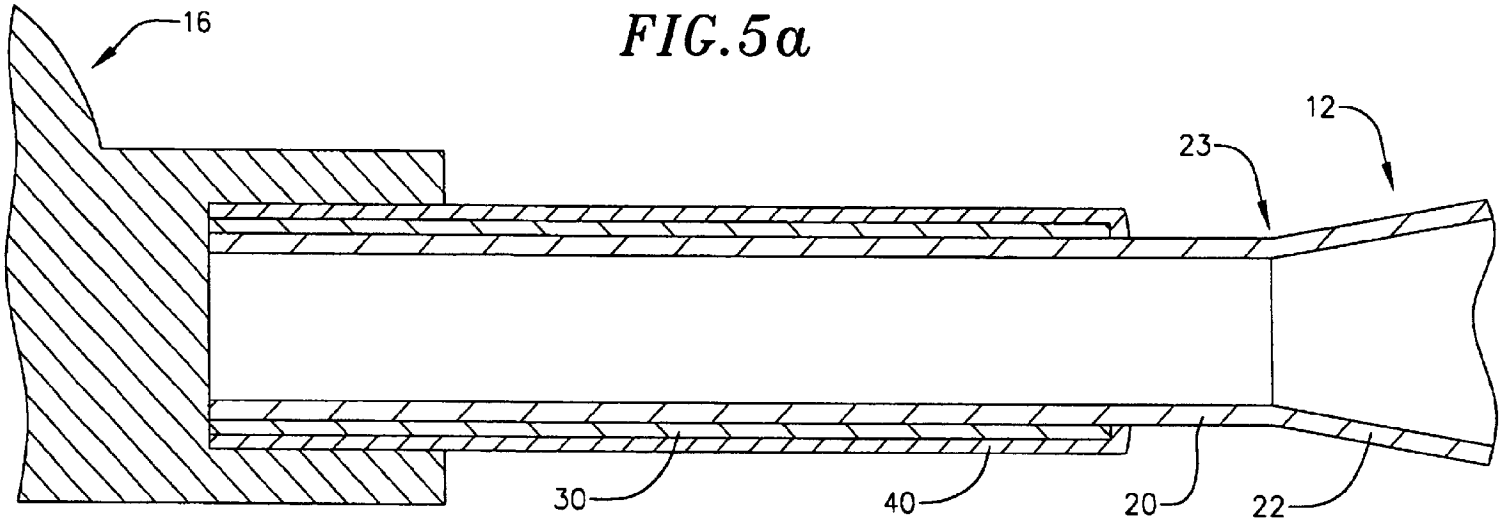
FIG. 5*a* is a section view of the tip region of the golf club illustrated in FIG. 1.

The metal layer 30 in the exemplary embodiments is preferably formed from a metal having relatively high tensile strength (about 200–350 Mpa) and a relatively high modulus of elasticity (about 70–200 GPa). Commercially pure titanium, 7000 series aluminum, and low alloy steel are suitable metals. Aluminum alloys, such as scandium-aluminum alloys, that have the desired tensile strength and modulus of elasticity characteristics may also be used. The thickness of the metal layer 30 will range from about 0.001 inch to about 0.006 inch when formed from these materials. Although not so limited, the metal layer will preferably be positioned such that it extends along the shaft from a point on the shaft within the club head hosel to a point on the shaft outside the club head hosel. This is because the area adjacent to the club head 16 is the area which is most effected by torsional forces and is also the area where conventional shafts are most likely to break. As illustrated in FIGS. 1 and 5*a*, the metal layer 30 in the exemplary embodiment is aligned with tip end 26 and extends along the tip section 20 to a point distal of the main body section 22.

Figure 5C:
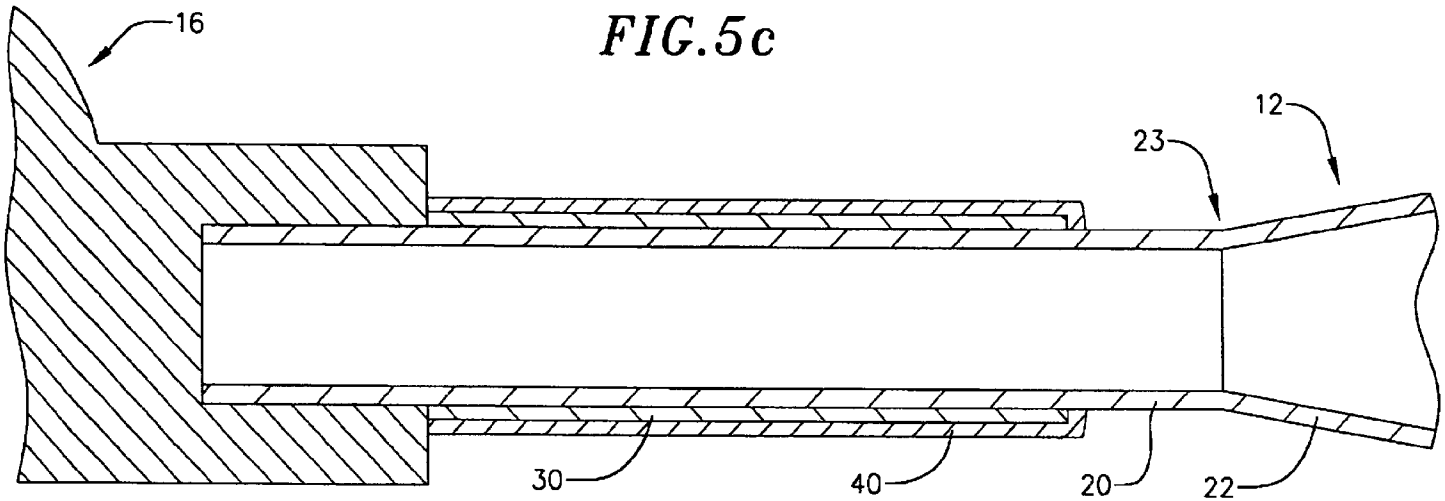
FIG. 5*c* is a section view of the tip region of a golf club in accordance with a preferred embodiment of a present invention.
Figure 5D:
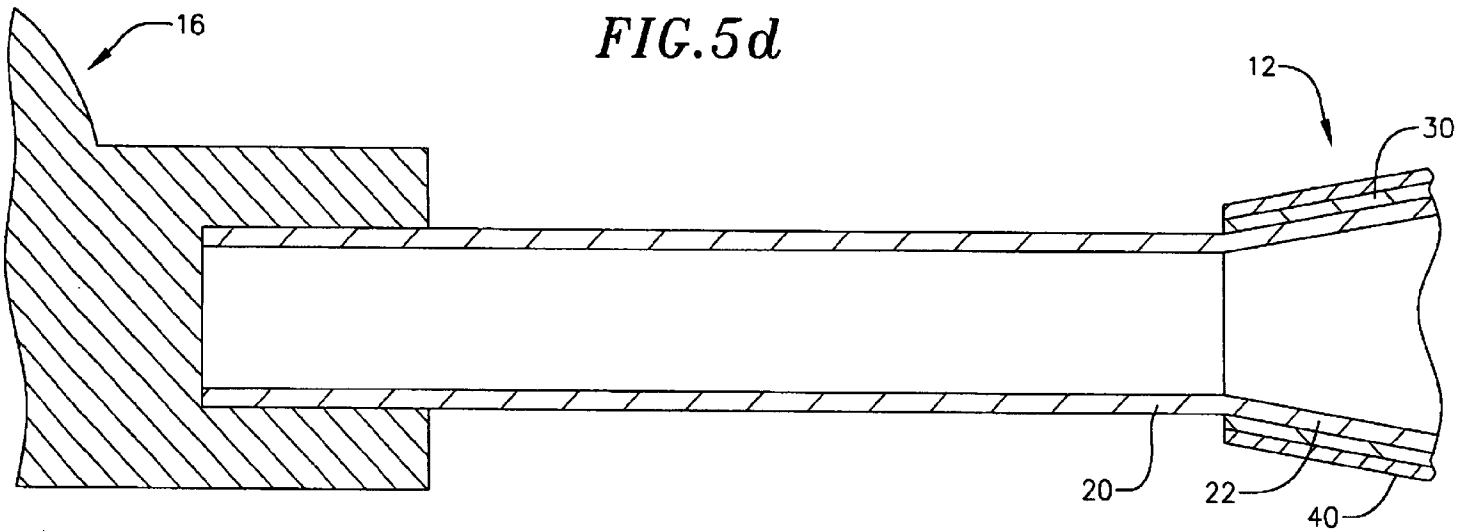
FIG. 5*d* is a section view of the tip region of a golf club in accordance with a preferred embodiment of a present invention.
Figure 6:
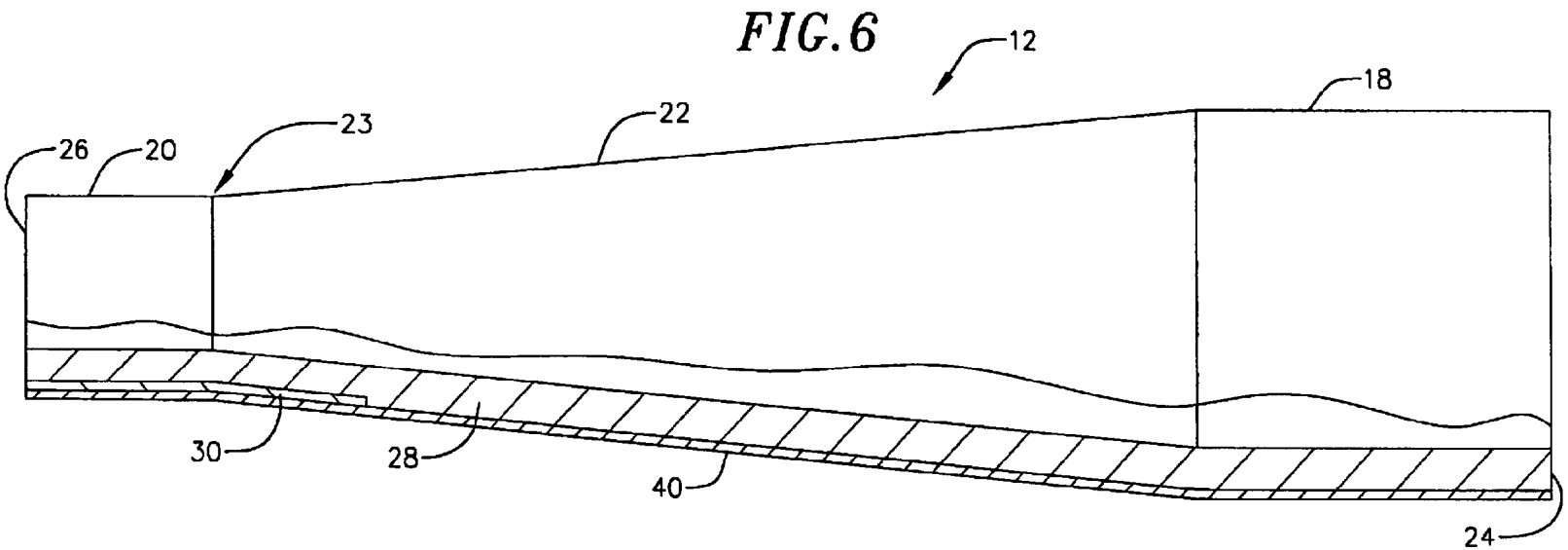
FIG. 6 is a cutaway, partial section view of the golf club shaft in accordance with a preferred embodiment of the present invention.

The length of the metal layer 30 will depend upon the dimensions of the overall shaft 12 and the intended shaft characteristics, such as stiffness and flex point location. Suitable lengths for golf club shafts range from about 5 inches to about 30 inches. However, there may be some instances where the metal layer 30 would extend over the entire length of the shaft. There may also be some instances where the metal layer 30 would extend over only a portion of the tip section 20 that will not be within the club head hosel when the golf club is assembled (FIG. 5*c*), or would extend over only some or all of the main body section 22 (FIG. 5*d*), or would extend over only some or all of the tip section and some or all of the main body section (FIG. 6), depending on the intended results. With respect to shafts for other shaft-base instruments, the metal layer may extend over the entire length of the base member, or over only a portion thereof, depending on the intended application.

The metal layer 30 is wrapped around the fiber reinforced resin composite base member 28 through the use of a rolling process during manufacturing. The rolling process may be performed by hand or with a rolling table. The metal sheet (or sheets) that make up the metal layer 30 should preferably be sized such that the metal wraps exactly a whole number multiple of times around the base member 28, e.g. exactly one time or exactly two times, but not 2½ times, in order to prevent the formation of spines.

Preferably, there will be a bonding layer 38 that secures the base member 28 and metal layer 30 to one another in the manner illustrated for example in FIGS. 3 and 4. The bonding layer 38, which has approximately the same measurements as the metal layer 30, can be formed from any suitable material. Suitable bonding layers include, but are not limited to, high resin content scrim cloth (about 40% resin content by weight or higher), a sheet of epoxy, spray on epoxy, tacking film, and a layer of fiber reinforced resin that is pre-impregnated with epoxy (about 40% resin content or higher). The bonding layer 38 should be secured to the metal layer 30 prior to wrapping the metal layer 30 around the base member 28. The bond between the metal layer 30 and the bonding layer 38 may be improved by roughening the surface of the metal layer that is in contact with the bonding layer prior to adding the bonding layer. This may be accomplished by, for example, chemical etching, sand blasting, or brushing the surface of the metal sheet (or sheets) used to form the metal layer 30.

Figure 5B:
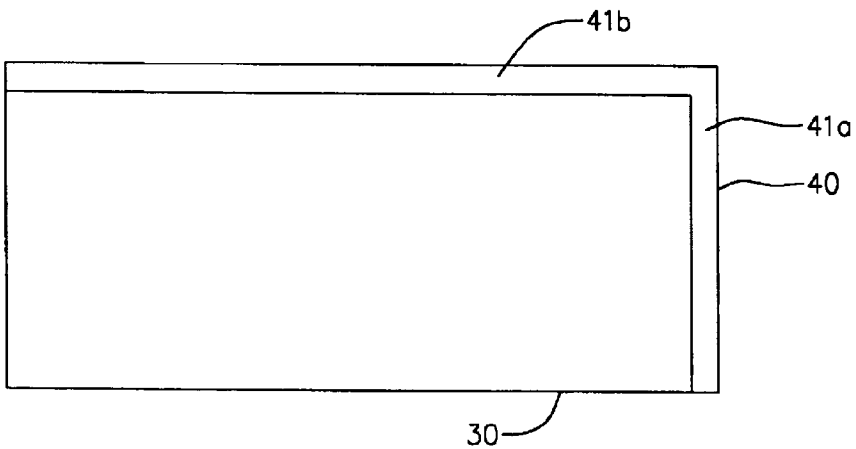
FIG. 5*b* is a plan view showing the relative sizes of the metal layer and outer layer in the golf club illustrated in FIG. 5*a*.

The metal layer 30 may have enough metal memory to cause it to unwind a bit after the rolling process. Thus, although not required, the exemplary shaft 12 also includes an outer layer 40 that is used to hold down the metal layer 30. Suitable outer layers include high resin content scrim cloth (about 40% resin content by weight or higher) and fiber reinforced resin that is pre-impregnated with epoxy (about 40% resin content or higher). The scrim cloth is advantageous in that the metal layer 30 will be visible through the scrim cloth. As shown in FIG. 5*b*, the outer layer 40 extends at least slightly beyond the metal layer 30 on at least two sides (e.g. at least ⅛ of an inch on two sides) in the exemplary embodiment so that an adhesive regions 41*a* and 41*b* will extend slightly beyond the metal layer 30. The adhesive region 41*a* will bond to the base member 28 and the adhesive region 41*b* will slightly overlap, and bond to, a portion of the outer layer 40. The outer layer 40 may, alternatively, cover the entire base member 28 (FIG. 6) or may cover the metal layer and some, but not all of the portion of the base member proximal of the metal layer.

Another suitable manufacturing technique is the bladder mold process. Here, the fiber reinforced resin, metal, adhesive, outer layers are prearranged and then wrapped together around a bladder with a small mandrel inside the bladder. A heated mold is placed over the wrapped bladder, the bladder is expanded to force the material against the mold, and the shaft is then cured in the mold. Curing times and temperatures depend on the polymer used in the composite and are well known to those of skill in the art. Filament winding techniques, where the process is stopped to change materials, may also be used. No adhesive is required here because the graphite tow is wet with epoxy or other adhesive.

Figure 7:
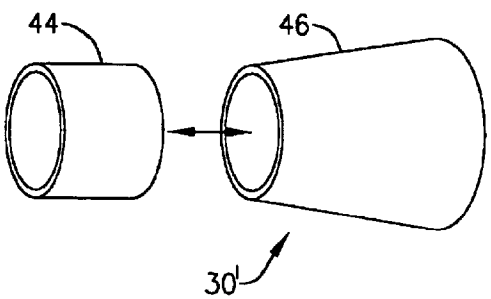
FIG. 7 is perspective view of a pair of metal layer members in accordance with a preferred embodiment of a present invention.

As noted above, the tip section 20 is substantially cylindrical, while the main body section 22 has a frusto-conical shape with a substantially constant taper. In some embodiments, such as that illustrated in FIG. 6, it may be desirable to extend the metal layer 30 into the main body section 22. The inventor herein has determined that the discontinuity of shape at the tip section/main body section junction 23 can, in some instances, make rolling the metal layer 30 onto the base member 28 difficult when the metal layer is formed from a single, continuous sheet of metal. One way to obviate this issue is to form the metal layer 30 from two separate metal layer members. As illustrated for example in FIG. 7, a metal layer 30' may be formed from a cylindrical metal layer member 44 and a frusto-conical metal layer member 46 that are arranged as close to one another as practicable in the assembled shaft. The metal layer members 44 and 46 are formed from separate sheets of metal that may be rolled onto the base member 28 separately or simultaneously.

Figure 8:
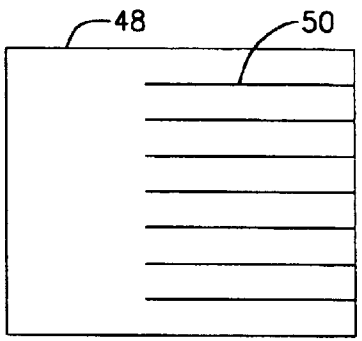
FIG. 8 is a plan view of a metal layer blank in accordance with a preferred embodiment of a present invention.
Figure 9:
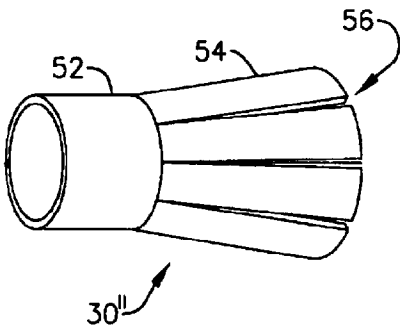
FIG. 9 is a perspective view of the metal layer formed by the metal layer blank illustrated in FIG. 8.

The rolling issue may also be obviated by forming a metal layer 30" from a metal sheet (or "blank") 48 having a plurality of longitudinally extending slits 50 formed therein in the manner illustrated for example in FIGS. 8 and 9. The length of the slits is 50 equal to the length of the portion of the metal layer within the main body section 22 (assuming that the end of the metal layer 30" opposite of the slits will be aligned with the tip end 26 of the shaft 12). When the metal sheet 48 is wrapped around the base member 28, the resulting metal layer 30" will include a cylindrical metal layer member 52 and a series of longitudinally extending metal layer members 54 that fan out from the cylindrical metal layer member to form the frusto-conical portion of the metal layer. The longitudinally extending slits 50 cause the formation of relief areas 56 between adjacent metal layer members 54, which increase in size as the distance from the cylindrical metal layer member 52 increases.

Although the present inventions have been described in terms of the preferred embodiment above, numerous modifications and/or additions to the above-described preferred embodiments would be readily apparent to one skilled in the art. By way of example, but not limitation, the present inventions include golf clubs including any of the shafts described above. It is intended that the scope of the present inventions extends to all such modifications and/or additions and that the scope of the present inventions is limited solely by the claims set forth below.

I claim:

1. A golf club shaft for use with a golf club head including a hosel having a predetermined length, the golf club shaft comprising:

a polymer base member defining a tip end, a cylindrical tip section adapted to be inserted into the hosel, a frusto-conical main body section, a grip section, a butt end and a longitudinal axis; and a metal layer extending around and secured to at least a portion of the base member tip section and defining distal and proximal ends, the metal layer being located such that the distal end of the metal layer is less than the predetermined length from the tip end and the proximal end of the metal layer is greater than the predetermined length from the tip end and including a circular portion, which defines a cylindrical shape, and a plurality of spaced longitudinally extending portions.

2. A golf club shaft as claimed in claim 1, wherein the circular portion of the metal layer is connected to the longitudinally extending portions of the metal layer.

3. A golf club shaft as claimed in claim 1, wherein the circular portion of the metal layer is associated with the tip section and the longitudinally extending portions of the metal layer are associated with the main body section.

4. A golf club shaft, comprising:

a base member including a plurality of fiber reinforced resin layers and defining a tip end a cylindrical tip section, a frusto-conical main body section, a grip section, and a butt end;

a metal layer extending around the base member, the metal layer including a cylindrical portion positioned around the tip section and a substantially frusto-conical portion, including a plurality of spaced longitudinally extending members, positioned around the main body section extending from the tip section to an area within the main body section short of the grip section; and a bonding layer between the base member and the metal layer.

5. A golf club shaft for use with a golf club head including a hosel having a predetermined length, the golf club shaft comprising:

a polymer base member defining a tip end, a tip section adapted to be inserted into the hosel, a main body section, a grip section, and a butt end;

a metal layer including a plurality of spaced metal members defining respective distal and proximal ends, the metal layer being located such that the distal ends of the metal members are greater than the predetermined length from the tip end and the proximal ends of the metal members are greater than the predetermined length from the tip end and distally spaced from the butt end;

an inner scrim cloth between the base member and the metal layer; and an outer scrim cloth over the metal layer.

6. A golf club shaft as claimed in claim 5, wherein the outer scrim cloth extends proximally beyond the proximal ends of the metal members.

7. A golf club shaft as claimed in claim 5, wherein the base member comprises a plurality of resin layers.

8. A golf club shaft as claimed in claim 7, wherein the plurality of resin layers comprises a plurality of fiber reinforced resin layers.

9. A golf club shaft as claimed in claim 5, wherein the proximal ends of the metal members are not connected to one another by a metal structure.

10. A golf club shaft for use with a golf club head including a hosel having a predetermined length, the golf club shaft comprising:

a polymer base member defining a tip end, a tip section adapted to be inserted into the hosel, a main body section, a grip section, and a butt end;

a metal layer including a plurality of spaced metal members defining respective distal and proximal ends, the metal layer being located such that the distal ends of the metal members are greater than the predetermined length from the tip end and the proximal ends of the metal members are greater than the predetermined length from the tip end and distally spaced from the butt end;

an inner bonding layer between the base member and the metal layer; and an outer scrim cloth over the metal layer.

11. A golf club shaft as claimed in claim 10, wherein the outer scrim cloth extends proximally beyond the proximal ends of the metal members.

12. A golf club shaft as claimed in claim 10, wherein the base member comprises a plurality of resin layers.

13. A golf club shaft as claimed in claim 12, wherein the plurality of resin layers comprises a plurality of fiber reinforced resin layers.

14. A golf club shaft as claimed in claim 10, wherein the proximal ends of the metal members are not connected to one another by a metal structure.

15. A golf club shaft as claimed in claim 10, wherein the inner bonding layer comprises a layer of resin that is pre-impregnated with epoxy.

16. A golf club shaft for use with a golf club head including a hosel having a predetermined length, the golf club shaft comprising:

a polymer base member defining a tip end, a tip section adapted to be inserted into the hosel, a main body section, a grip section, and a butt end;

a metal layer including a plurality of spaced metal members defining respective distal and proximal ends, the metal layer being located such that the proximal ends of the metal members are greater than the predetermined length from the tip end and distally spaced from the butt end;

an inner scrim cloth between the base member and the metal layer; and an outer scrim cloth over the metal layer.

17. A golf club shaft as claimed in claim 16, wherein the outer scrim cloth extends proximally beyond the proximal ends of the metal members.

18. A golf club shaft as claimed in claim 16, wherein the base member comprises a plurality of resin layers.

19. golf club shaft as claimed in claim 18, wherein the plurality of resin layers comprises a plurality of fiber reinforced resin layers.

20. A golf club shaft as claimed in claim 16, wherein the proximal ends of the metal members are not connected to one another by a metal structure.

* * * * *